US010490326B2

(12) United States Patent
Lee et al.

(10) Patent No.: US 10,490,326 B2
(45) Date of Patent: Nov. 26, 2019

(54) METHOD OF PRODUCING RARE EARTH PERMANENT MAGNET

(71) Applicants: Hyundai Motor Company, Seoul (KR); Kia Motors Corporation, Seoul (KR); Star Group Ind. Co., Ltd., Daegu (KR)

(72) Inventors: Jae Ryung Lee, Hwaseong-si (KR); Dong Hwan Kim, Daegu (KR); Koon Seung Kong, Daegu (KR)

(73) Assignees: Hyundai Motor Company, Seoul (KR); Kia Motors Corporation, Seoul (KR); Star Group Ind. Co., Ltd., Daegu (KR)

( * ) Notice: Subject to any disclaimer, the term of this patent is extended or adjusted under 35 U.S.C. 154(b) by 8 days.

(21) Appl. No.: 15/802,330

(22) Filed: Nov. 2, 2017

(65) Prior Publication Data

US 2018/0166192 A1 Jun. 14, 2018

(30) Foreign Application Priority Data

Dec. 12, 2016 (KR) ..... 10-2016-0168729
Jun. 16, 2017 (KR) ..... 10-2017-0076368

(51) Int. Cl.

| | |
|---|---|
| ***H01F 1/057*** | (2006.01) |
| ***H01F 41/02*** | (2006.01) |
| ***B22F 3/10*** | (2006.01) |
| ***B22F 9/04*** | (2006.01) |
| ***C22C 1/04*** | (2006.01) |

(52) U.S. Cl.

CPC ..... *H01F 1/0577* (2013.01); *B22F 3/10* (2013.01); *B22F 9/04* (2013.01); *C22C 1/0441* (2013.01); *H01F 41/0293* (2013.01); *B22F 2999/00* (2013.01)

(58) Field of Classification Search

None

See application file for complete search history.

(56) References Cited

U.S. PATENT DOCUMENTS

2012/0280775 A1* 11/2012 Nagata ..... B22F 3/24 335/302
2017/0263380 A1* 9/2017 Mino ..... B22F 3/24

FOREIGN PATENT DOCUMENTS

KR 10-2006-0057540 A 5/2006
KR 10-2012-0124039 A 11/2012
KR 10-1447301 B1 10/2014

* cited by examiner

*Primary Examiner* — Xiaowei Su
(74) *Attorney, Agent, or Firm* — Morgan, Lewis & Bockius LLP

(57) ABSTRACT

Disclosed is a method of producing a rare earth permanent magnet including preparing a NdFeB sintered magnet, coating a surface of the NdFeB sintered magnet with a grain boundary diffusion material including R hydrate or R fluoride, and $R_aM_b$ or M, to form a grain boundary diffusion coating layer, and diffusing the grain boundary diffusion material into a grain boundary of the NdFeB sintered magnet by heat treatment, wherein M is a metal having a melting point higher than a heat treatment temperature during the diffusion, R is a rare earth element, and a and b each represent atomic percentages which satisfy the following Equations (1) and (2):

$$0.1<a<99.9 \quad (1)$$

$$a+b=100 \quad (2).$$

8 Claims, 5 Drawing Sheets

FIG. 3

| $DyF_3$+Co | | | | | | | |
|---|---|---|---|---|---|---|---|
| Grain boundary diffusion | Composition (wt%) | | Comparison of Magnetic characteristics | | | | Thermal demagnetization rate(%) |
| | $DyF_3$ | Co | Br | Hcj | (BH)max | ΔHcj | |
| Before | 0 | 0 | 13.3 | 17.5 | 43.4 | 0 | 10.2 |
| After | 99 | 1 | 13.2 | 22.6 | 42.7 | 5.1 | 2 |
| | 97 | 3 | 13.2 | 23 | 42.7 | 5.5 | 1.8 |
| | 95 | 5 | 13.2 | 23.2 | 42.7 | 5.7 | 1.8 |
| | 93 | 7 | 13.2 | 22.9 | 42.7 | 5.4 | 1.8 |
| | 90 | 10 | 13.2 | 22.3 | 42.7 | 4.8 | 2.3 |
| | 85 | 15 | 13.2 | 21.8 | 42.7 | 4.3 | 2.6 |
| | 80 | 20 | 13.2 | 21.6 | 42.7 | 4.1 | 3 |

| $DyH_2$+Co | | | | | | | |
|---|---|---|---|---|---|---|---|
| Grain boundary diffusion | Composition (wt%) | | Comparison of Magnetic characteristics | | | | Thermal demagnetization rate(%) |
| | $DyH_2$ | Co | Br | Hcj | (BH)max | ΔHcj | |
| Before | 0 | 0 | 13.3 | 17.5 | 43.4 | 0 | 10.2 |
| After | 99 | 1 | 13.2 | 24.2 | 42.7 | 6.7 | 1.8 |
| | 97 | 3 | 13.2 | 24.7 | 42.7 | 7.2 | 1.6 |
| | 95 | 5 | 13.2 | 24.6 | 42.7 | 7.1 | 1.6 |
| | 93 | 7 | 13.2 | 24.4 | 42.7 | 6.9 | 1.8 |
| | 90 | 10 | 13.2 | 23.9 | 42.7 | 6.4 | 1.9 |
| | 85 | 15 | 13.2 | 22.2 | 42.7 | 4.7 | 2.3 |
| | 80 | 20 | 13.2 | 21.1 | 42.7 | 3.6 | 3 |

| $TbF_3$+Co | | | | | | | |
|---|---|---|---|---|---|---|---|
| Grain boundary diffusion | Composition (wt%) | | Comparison of Magnetic characteristics | | | | Thermal demagnetization rate(%) |
| | $TbF_3$ | Co | Br | Hcj | (BH)max | ΔHcj | |
| Before | 0 | 0 | 13.3 | 17.5 | 43.4 | 0 | 10.2 |
| After | 99 | 1 | 13.2 | 27.7 | 42.7 | 10.2 | 1.2 |
| | 97 | 3 | 13.2 | 28 | 42.7 | 10.5 | 1 |
| | 95 | 5 | 13.2 | 28.5 | 42.7 | 11 | 0.9 |
| | 93 | 7 | 13.2 | 27.9 | 42.7 | 10.4 | 1 |
| | 90 | 10 | 13.2 | 27.5 | 42.7 | 10 | 1.1 |
| | 85 | 15 | 13.2 | 27 | 42.7 | 9.5 | 1.6 |
| | 80 | 20 | 13.2 | 26.2 | 42.7 | 8.7 | 2 |

| $TbH_2$+Co | | | | | | | |
|---|---|---|---|---|---|---|---|
| Grain boundary diffusion | Composition (wt%) | | Comparison of Magnetic characteristics | | | | Thermal demagnetization rate(%) |
| | $TbH_2$ | Co | Br | Hcj | (BH)max | ΔHcj | |
| Before | 0 | 0 | 13.3 | 17.5 | 43.4 | 0 | 10.2 |
| After | 99 | 1 | 13.2 | 29.7 | 42.7 | 12.2 | 0.8 |
| | 97 | 3 | 13.2 | 30.1 | 42.7 | 12.6 | 0.6 |
| | 95 | 5 | 13.2 | 30.6 | 42.7 | 13.1 | 0.6 |
| | 93 | 7 | 13.2 | 30 | 42.7 | 12.5 | 0.8 |
| | 90 | 10 | 13.2 | 29.3 | 42.7 | 11.8 | 0.9 |
| | 85 | 15 | 13.2 | 28.2 | 42.7 | 10.7 | 1.8 |
| | 80 | 20 | 13.2 | 27 | 42.7 | 9.5 | 2.6 |

FIG. 4

| Items | | Coating material | | Comparison in magnetic characteristics | | | | Thermal demagnetization rate(%) |
|---|---|---|---|---|---|---|---|---|
| | | R compound | M | Br | Hcj | (BH)max | ΔHcj | |
| Before diffusion | - | 0 | 0 | 13.3 | 17.5 | 43.4 | 0 | 10.2 |
| After diffusion | Comparative Example 1 | $TbH_2$ (99wt%) | Zn (1wt%) | 12.9 | 21.8 | 43.2 | 4.3 | 10.3 |
| | Comparative Example 2 | $TbH_2$ (90wt%) | Zn (10wt%) | 12.9 | 21.8 | 43.2 | 4.3 | 12.1 |
| | Comparative Example 3 | $TbH_2$ (99wt%) | Zn+Al (1wt%) | 12.8 | 19.4 | 43.1 | 1.9 | 9.4 |
| | Comparative Example 4 | $TbF_3$ (90wt%) | Zn (10wt%) | 12.8 | 23.4 | 42.9 | 5.9 | 10.7 |
| | Comparative Example 5 | $TbH_2$ (90wt%) | Zn+Al (10wt%) | 12.7 | 21.6 | 42.6 | 4.1 | 9.1 |

METHOD OF PRODUCING RARE EARTH PERMANENT MAGNET

CROSS-REFERENCE(S) TO RELATED APPLICATIONS

The present application claims priority to Korean Patent Application No. 10-2016-0168729, filed on Dec. 12, 2016, and Korean Patent Application No. 10-2017-0076368, filed on Jun. 16, 2017, the entire contents of which is incorporated herein for all purposes by this reference.

BACKGROUND OF THE INVENTION

Field of the Invention

The present invention relates to a method of producing a rare earth permanent magnet including: applying an alloy powder including a rare earth element and heat-treating the same to diffuse the rare earth element into the grain boundary of a sintered magnet. More particularly, the present invention relates to a method of producing a rare earth permanent magnet which includes diffusing a rare earth element into the grain boundary of a Nd—Fe—B sintered magnet using an alloy powder including cobalt (Co) to improve coercive force and alleviate thermal demagnetization characteristics.

Description of Related Art

In general, a rare earth permanent magnet, which is a magnet having strong magnetic force including an R—Fe—B sintered magnet (wherein R represents a rare earth element including neodymium (Nd), dysprosium (Dy), or terbium (Tb), or a combination thereof), imparts high power and reduced size to motors, and the application range thereof is thus gradually widening.

In particular, it is expected that the recent increased demand for hybrid or electric vehicles will bring about an increase in the demand for rare earth permanent magnets that can exert three to five-fold improved magnetic force as compared to conventional ferrite magnets.

Meanwhile, magnetic characteristics of magnets can be represented by a remanent magnetic flux density and coercive force. The remanent magnetic flux density is determined by the proportion, density, and magnetic orientation of the main phase of the rare earth permanent magnet, and the coercive force refers to the ability of a magnet to withstand an external magnetic field or heat. The coercive force is crucially relevant to the microstructures of the magnet and is determined by fine grain sizes or uniform distribution of grain boundary phases.

Accordingly, various alternative methods of improving coercive force of permanent magnets have been suggested. Thereamong, bi-alloying is a method of producing a magnet by mixing two kinds of alloy powders, then conducting magnetic field formation and sintering.

More specifically, the above method realizes high coercive force by producing a permanent magnet from mixing an R—Fe—B powder (wherein R represents a rare earth element) including neodymium (Nd) or praseodymium (Pr) as a rare earth element with an alloy powder including dysprosium (Dy) or terbium (Tb) as well as aluminum (Al), titanium (Ti), molybdenum (Mo) or the like. However, during the sintering, dysprosium (Dy) and terbium (Tb) elements of the alloy powder diffuse into the grain boundary, disadvantageously, causing deterioration in the desired effect.

Accordingly, recently, there is generally used grain boundary diffusion including forming a coating layer including a rare earth element including dysprosium (Dy) or terbium (Tb) on the surface of a sintered magnet, and then inducing grain boundary diffusion into the sintered magnet to improve the magnetic characteristics including coercive force.

Grain boundary diffusion is broadly classified into two methods according to the manner of coating layer formation. A method which includes first forming a coating layer using dysprosium (Dy) or terbium (Tb) on a surface of the sintered magnet by sputtering or deposition and then inducing grain boundary diffusion has the disadvantages of tremendous manufacturing costs required for manufacturing equipment and processes, and difficulty in mass-production due to poor productivity and efficiency.

In addition, the another method includes first coating the surface of the sintered magnet with dysprosium (Dy) and terbium (Tb) in the form of oxide or fluoride and then inducing grain boundary diffusion is advantageously realized by a relatively simple process while having excellent productivity, but disadvantageously has a limitation in improving the coercive force due to difficulties in diffusing elements including dysprosium (Dy) and terbium (Tb) into the sintered magnet since these elements are diffused by a substitution reaction. In particular, fluoride and oxide suppress grain boundary diffusion of pure rare earth elements and remain in the produced permanent magnet, thus disadvantageously limiting the improvement of the coercive force.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a method of producing a rare earth permanent magnet that can exert an improved coercive force and thermal characteristics by effectively diffusing heavy rare earth elements along the grain boundaries of a sintered magnet.

Various aspects of the present invention are directed to providing a method of producing a rare earth permanent magnet that can uniformly diffuse heavy rare earth elements while improving the grain boundary diffusion rate of the heavy rare earth elements.

Various aspects of the present invention are directed to providing a method of producing a rare earth permanent magnet that can omit a process of removing an oxide film after grain boundary diffusion by improving a corrosion resistance.

In accordance with various aspects of the present invention, the above and other objects can be accomplished by the provision of a method of producing a rare earth permanent magnet including preparing a NdFeB sintered magnet, coating a surface of the NdFeB sintered magnet with a grain boundary diffusion material including R hydrate or R fluoride, and $R_aM_b$ or M, to form a grain boundary diffusion coating layer, and diffusing the grain boundary diffusion material into a grain boundary of the NdFeB sintered magnet by heat treatment, wherein M is a metal having a melting point higher than a heat treatment temperature during the diffusion process, R is a rare earth element, and a and b each represent atomic percentages which satisfy the following Equations (1) and (2):

$$0.1<a<99.9 \quad (1)$$

$$a+b=100 \quad (2)$$

Preferably, M is a metal having a melting point of 1,000° C. or higher.

More preferably, R is any one selected from dysprosium (Dy), terbium (Tb), neodymium (Nd), praseodymium (Pr) and holmium (Ho), and M is cobalt (Co).

In the preparing, the NdFeB sintered magnet may include 30 to 35 wt % of the total weight of rare earth elements including dysprosium (Dy), terbium (Tb), neodymium (Nd), and praseodymium (Pr), 0 to 10 wt % of the total weight of transition metals including cobalt (Co), aluminum (Al), copper (Cu), gallium (Ga), zirconium (Zr), and niobium (Nb), 10 wt % of boron (B) and the balance of iron (Fe).

In the coating, the grain boundary diffusion material may include 1 to 7 wt % of cobalt (Co).

In the coating, R hydrate may be any one of $TbH_2$, $TbH_3$, $DyH_2$, and $DyH_3$, and R fluoride may be any one of $TbF_2$, $TbH_3$, $DyF_2$, and $DyF_3$.

In the coating, the coating layer may be formed by coating the surface of the NdFeB sintered magnet with the grain boundary diffusion material by spraying, suspension adhesion, or barrel painting.

The grain boundary diffusion material may include R in an amount that is within the range of 10 to 70 wt % and is higher than an amount of the rare earth element present in the NdFeB sintered magnet.

The coating may include melting R hydrate or R fluoride, and $R_aM_b$ or M, to prepare a cobalt molten alloy, cooling the cobalt molten alloy to prepare a cobalt alloy ingot, grinding the cobalt alloy ingot to prepare a powdery grain boundary diffusion material, and coating the surface of the NdFeB sintered magnet with the grain boundary diffusion material to form the grain boundary diffusion coating layer.

The diffusing may be conducted by heating to a temperature of 700 to 1,000° C. under an inert atmosphere.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

FIG. 3 is a table showing magnetic characteristics and thermal demagnetization rate before and after grain boundary diffusion with regard to rare earth permanent magnets provided using grain boundary diffusion materials according to various examples of the present invention;

FIG. 4 is a table showing magnetic characteristics and thermal demagnetization rate before and after grain boundary diffusion with regard to rare earth permanent magnets including a low-melting point metal provided using various comparative examples.

Figure 1:
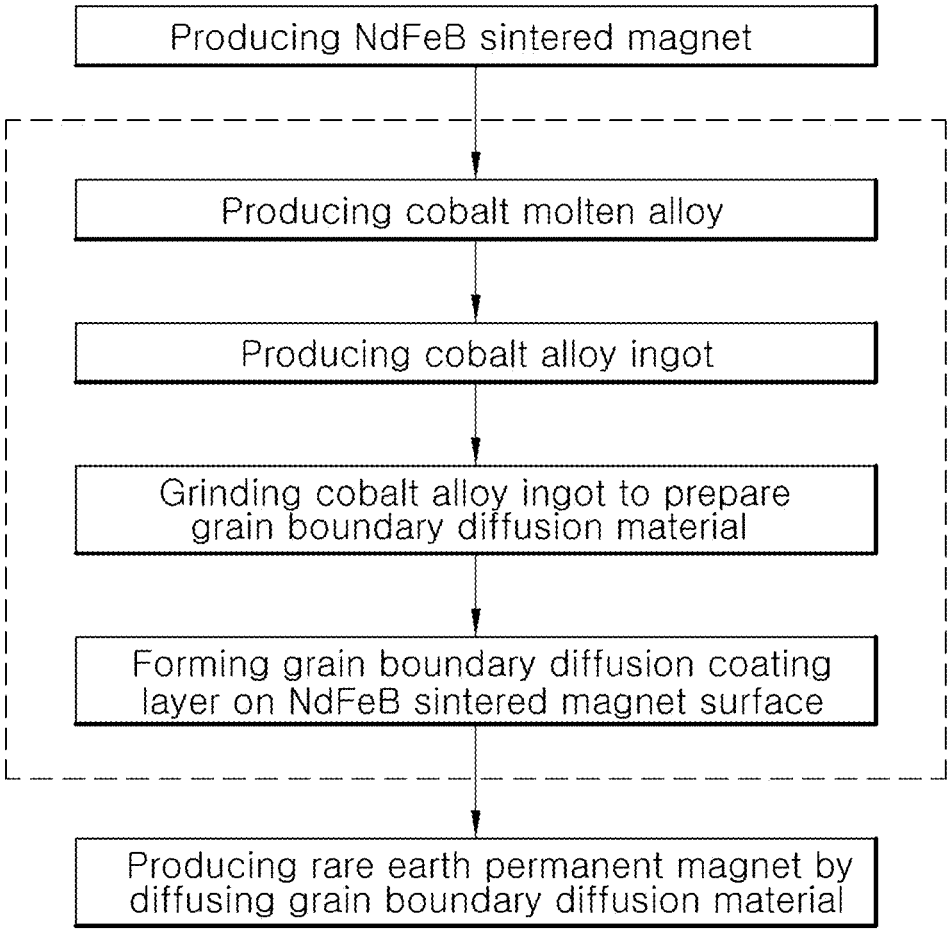
FIG. 1 is a flowchart illustrating a method of producing a rare earth permanent magnet according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

The present invention can facilitate diffusion of rare earth elements through the diffusion of the rare earth elements together with a metal having a melting point of 1,000° C. or higher in the production of a rare earth permanent magnet, wherein the magnetic characteristics including coercive force of the produced rare earth permanent magnet can be improved, thermal demagnetization rate can be reduced, and the overall process can be simplified through omission of an additional process of removing an oxide film.

Figure 2:
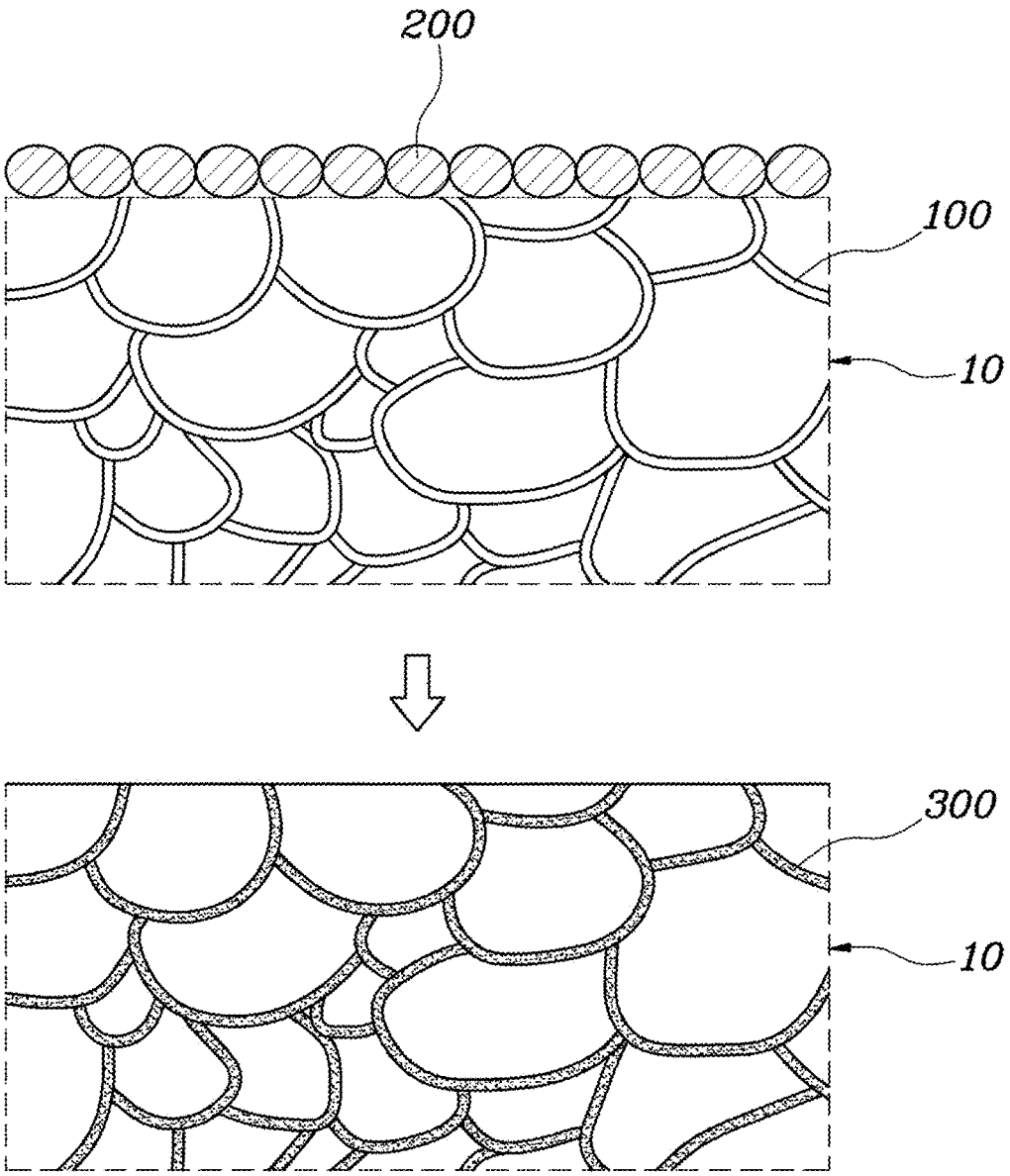
FIG. 2 is a schematic view illustrating a method of producing a rare earth permanent magnet according to an exemplary embodiment of the present invention.

FIG. 1 is a flowchart illustrating a method of producing a rare earth permanent magnet according to an exemplary embodiment of the present invention, and FIG. 2 is a schematic view illustrating a method of producing a rare earth permanent magnet according to an exemplary embodiment of the present invention.

As shown in FIG. 1 and FIG. 2, the method of producing a rare earth permanent magnet according to an exemplary embodiment of the present invention includes preparing a NdFeB sintered magnet 10, coating to form a grain boundary diffusion coating layer on the surface of the NdFeB sintered magnet 10, and diffusing a grain boundary diffusion material 200.

In the preparation step, for the prepared NdFeB sintered magnet 10 to include about 30 wt % to about 35 wt % (e.g., about 30 wt %, about 31 wt %, about 32 wt %,) about 33 wt %, about 34 wt %, or about 35 wt %) of the total weight of rare earth elements including dysprosium (Dy), terbium (Tb), neodymium (Nd), and praseodymium (Pr), 0 wt % to about 10 wt % (e.g., about 0 wt %, 1 wt %, 2 wt %, 3 wt %, 4 wt %, 5 wt %, 6 wt %, 7 wt %, 8 wt %, 9 wt %, or 10 wt %) of the total weight of transition metals including cobalt (Co), aluminum (Al), copper (Cu), gallium (Ga), zirconium (Zr), and niobium (Nb), 10 wt % of boron (B) and the balance of iron (Fe), these elements are mixed in a predetermined weight ratio, are melted by heating the material to a temperature of about 1,300° C. to about 1,550° C. (e.g., about 1,300° C., about 1,350° C., about 1,400° C., about 1,450° C., or about 1,550° C.) using a high frequency furnace, and are then produced into a NdFeB alloy by strip casting.

The prepared NdFeB alloy is coarsely crushed by hydrogenation and dehydrogenation and finely ground using a jet-mill to prepare a NdFeB powder. In the present case, the NdFeB powder preferably has a diameter of about 3 μm to 5 μm (e.g., about 3 μm, about 4 μm, or about 5 μm).

After the NdFeB powder is provided as such, the NdFeB powder is sintered and heat-treated using a magnetic field forming machine having a magnetic field direction and a forming direction vertical to each other to produce a NdFeB sintered magnet 10.

The preparation according to an exemplary embodiment of the present invention is preferably conducted under an inert atmosphere charged with nitrogen (N) or argon (Ar) gas. The reason for the present conditions is that deterioration in magnetic characteristics of the NdFeB sintered magnet 10 can be minimized by minimizing impurities including carbon (C) or oxygen (O).

After completion of the NdFeB sintered magnet 10 as such, in the coating step, the surface of the NdFeB sintered magnet 10 is coated with a grain boundary diffusion material 200 to form a grain boundary diffusion coating layer.

The grain boundary diffusion material 200 according to an exemplary embodiment of the present invention includes a rare earth element represented by R hydrate or R fluoride, and cobalt (Co) or a cobalt alloy represented by M or $R_aM_b$.

In the present case, R is a rare earth element which is any one selected from dysprosium (Dy), terbium (Tb), neodymium (Nd), praseodymium (Pr), and holmium (Ho), M is a metal with a melting point of about 1,000° C. or higher, and a and b each represent atomic percentages which satisfy the following Equations (1) and (2):

$$0.1<a<99.9 \quad (1)$$

$$a+b=100 \quad (2)$$

More specifically, in an exemplary embodiment of the present invention, R hydrate is any one selected from $TbH_2$, $TbH_3$, $DyH_2$, and $DyH_3$, R fluoride is any one selected from $TbF_2$, $TbH_3$, $DyF_2$, and $DyF_3$, and M is cobalt (Co).

The cobalt (Co) used in an exemplary embodiment of the present invention is one of high-melting point metals, which has a relatively high melting point of 1,498° C. In the subsequent diffusion step, as heating is conducted for grain boundary diffusion of the rare earth element, cobalt (Co) is melted together with R hydrate or R fluoride to form a molten cobalt compound, that is, a liquid grain boundary diffusion material with a lowered melting point.

Accordingly, facilitation of diffusion through improvement in dispersibility and elevation of the grain boundary diffusion rate of the grain boundary diffusion material 200 including a rare earth element can advantageously bring about improvements in the magnetic characteristics of the produced rare earth permanent magnet, not to mention the uniform quality of the rare earth permanent magnet.

In the present case, when a low-melting point metal including zinc (Zn) or aluminum (Al) having a relatively low melting point lower than 700° C. is used as M, there is an advantage that dysprosium (Dy) and terbium (Tb) can be rapidly diffused into the grain boundary of the sintered magnet due to the lowered melting point of dysprosium (Dy) and terbium (Tb), but there is no effect on the Curie temperature of the produced magnet and the thermal demagnetization characteristics thus cannot be improved.

On the other hand, cobalt (Co), a metal with a high melting point that is used in an exemplary embodiment of the present invention, can improve the magnetic characteristics at high temperatures owing to weaker oxidizing power and a higher Curie temperature than neodymium (Nd). Cobalt (Co) is substituted by neodymium (Nd) present in the grain boundary of the NdFeB sintered magnet 10 and grains adjacent thereto, advantageously reducing thermal demagnetization rate of the produced magnet and improving corrosion resistance.

The The grain boundary diffusion material 200 according to an exemplary embodiment of the present invention includes the rare earth element represented by R in an amount that is within the range from about 10 wt % to about 70 wt % (e.g., about 10 wt %, about 20 wt %, about 30 wt %, about 40 wt %, about 50 wt %, about 60 wt %, or about 70 wt %) and is higher than an amount of the rare earth element present in the NdFeB sintered magnet 10.

The reason for limiting the content of the rare earth element within the above range is that, when the amount of the rare earth element in the grain boundary diffusion material 200 is less than 10 wt %, magnetic characteristics cannot be satisfactorily improved due to the small amount of the rare earth element diffused into the grain boundary 100, and when the amount exceeds 70 wt %, the price of the produced rare earth permanent magnet increases due to the waste of expensive rare earth elements and thus increased production costs.

In addition, when the amount of the rare earth element present in the grain boundary diffusion material 200 is lower than the amount of the rare earth element present in the NdFeB sintered magnet, the magnetic characteristics cannot be satisfactorily improved due to the lowered diffusion effect into the grain boundary of the NdFeB sintered magnet. Accordingly, the diffusion efficiency is preferably improved by incorporating the rare earth element in the grain boundary diffusion material in a predetermined amount higher than an amount of the rare earth element in the NdFeB sintered magnet.

Meanwhile, cobalt (Co) is preferably present in an amount of about 1 wt % to about 7 wt % (e.g., about 1 wt %, about 2 wt %, about 3 wt %, about 4 wt %, about 5 wt %, about 6 wt %, or about 7 wt %). The reason for the present amounts is that, when the content of the cobalt (Co) is less than 1 wt %, the effect of cobalt (Co) on improving the coercive force can be barely obtained and the desired heat resistance of the magnet cannot be acquired. When the cobalt (Co) content exceeds 7 wt %, the magnetic characteristics including the coercive force of the rare earth permanent magnet are somewhat deteriorated due to the low proportion of cobalt (Co) melted with R hydrate or R fluoride to form the molten cobalt compound.

The coating step according to an exemplary embodiment of the present invention includes melting R hydrate or R fluoride with $R_aM_b$ or M to prepare a molten cobalt alloy, charging the molten cobalt alloy in a mold and allowing the alloy to cool to prepare a cobalt alloy ingot, grinding the prepared cobalt alloy ingot using a ball-mill to prepare a powdery grain boundary diffusion material 200, and coating the surface of the NdFeB sintered magnet 10 with the powdery grain boundary diffusion material 200 to form a grain boundary diffusion coating layer.

At the present time, the grain boundary diffusion coating layer can be formed by any method of spraying, suspension adhesion, and barrel painting.

Spraying is a method of spraying the powdery grain boundary diffusion material 200 together with a solvent onto the surface of the NdFeB sintered magnet 10 using a spray. Suspension adhesion is a method including suspending the powdery grain boundary diffusion material 200 in a solvent including alcohol, immersing the NdFeB sintered magnet 10 in the suspension and drying the suspension adhered to the surface of the NdFeB sintered magnet 10 while raising the magnet.

In addition, barrel painting is a method of coating the surface of the NdFeB sintered magnet 10 with the grain boundary diffusion material 200 including applying an adhesive material including liquid paraffin to the surface of the NdFeB sintered magnet 10 to form an adhesive layer, mixing the powdery grain boundary diffusion material 200 with a metallic or ceramic impact media having a diameter of approximately 1 mm, incorporating the NdFeB sintered magnet 10 in the mixture and stirring under vibration to attach the grain boundary diffusion material 200 to the adhesive layer by the impact media.

According to an exemplary embodiment of the present invention, the thickness of the grain boundary diffusion coating layer coated onto the surface of the NdFeB sintered magnet 10 is preferably about 5 μm to about 150 μm (e.g., about 5 μm, about 10 μm, about 15 μm, about 20 μm, about 25 μm, about 30 μm, about 40 μm, about 50 μm, about 60 μm, about 70 μm, about 80 μm, about 90 μm, about 100 μm, about 110 μm, about 120 μm, about 130 μm, about 140 μm, or about 150 μm). The reason for the present dimensions is that, when the thickness of the grain boundary diffusion coating layer exceeds 150 μm, grain boundary diffusion of the grain boundary diffusion material 200 including expensive rare earth elements is difficult and, when the thickness is less than 5 μm, the effect of the grain boundary diffusion regarding improvement in coercive force is not sufficient.

After formation of the grain boundary diffusion coating layer is completed as described above, the liquid grain boundary diffusion material 200 melted by heating to a temperature of 700 to 1,000° C. in the diffusion step diffuses into the grain boundary 100 of the NdFeB sintered magnet 10 to form a grain boundary 300 where the grain boundary diffusion material diffuses, producing a rare earth permanent magnet.

Hereinafter, an exemplary embodiment of the present invention will be described in detail with reference to the annexed drawings.

TABLE 1

| Items | Nd | Pr | Dy | Tb | Co | B | Al | Cu | C | O | Fe |
|---|---|---|---|---|---|---|---|---|---|---|---|
| wt % | 27 | 1 | 1 | 1 | 2 | 1 | 0.5 | 0.25 | 0.01 | 0.12 | Bal. |

Table 1 shows a composition of the NdFeB sintered magnet produced according to an exemplary embodiment of the present invention.

The surface of the NdFeB sintered magnet 10 having the composition of Table 1 was coated with a grain boundary diffusion material 200 having a variety of compositions and heat-treated at 800° C. for 4 hours to induce grain boundary diffusion. Magnetic characteristics and thermal demagnetization rates were determined, and are shown in FIG. 3 and FIG. 4.

As seen from Table 1, FIG. 3, and FIG. 4, when a grain boundary diffusion material including a low-melting point metal including zinc or aluminum is used, the coercive force, magnetic flux density and the like are improved, but the thermal characteristics of the rare earth permanent magnet with a similar thermal demagnetization rate cannot be improved.

On the other hand, when the composition of the grain boundary diffusion material 200 satisfies the conditions defined in an exemplary embodiment of the present invention, magnetic characteristics including coercive force are excellent and thermal characteristics of the produced rare earth permanent magnet are improved due to a deteriorated thermal demagnetization rate.

Figure 5:
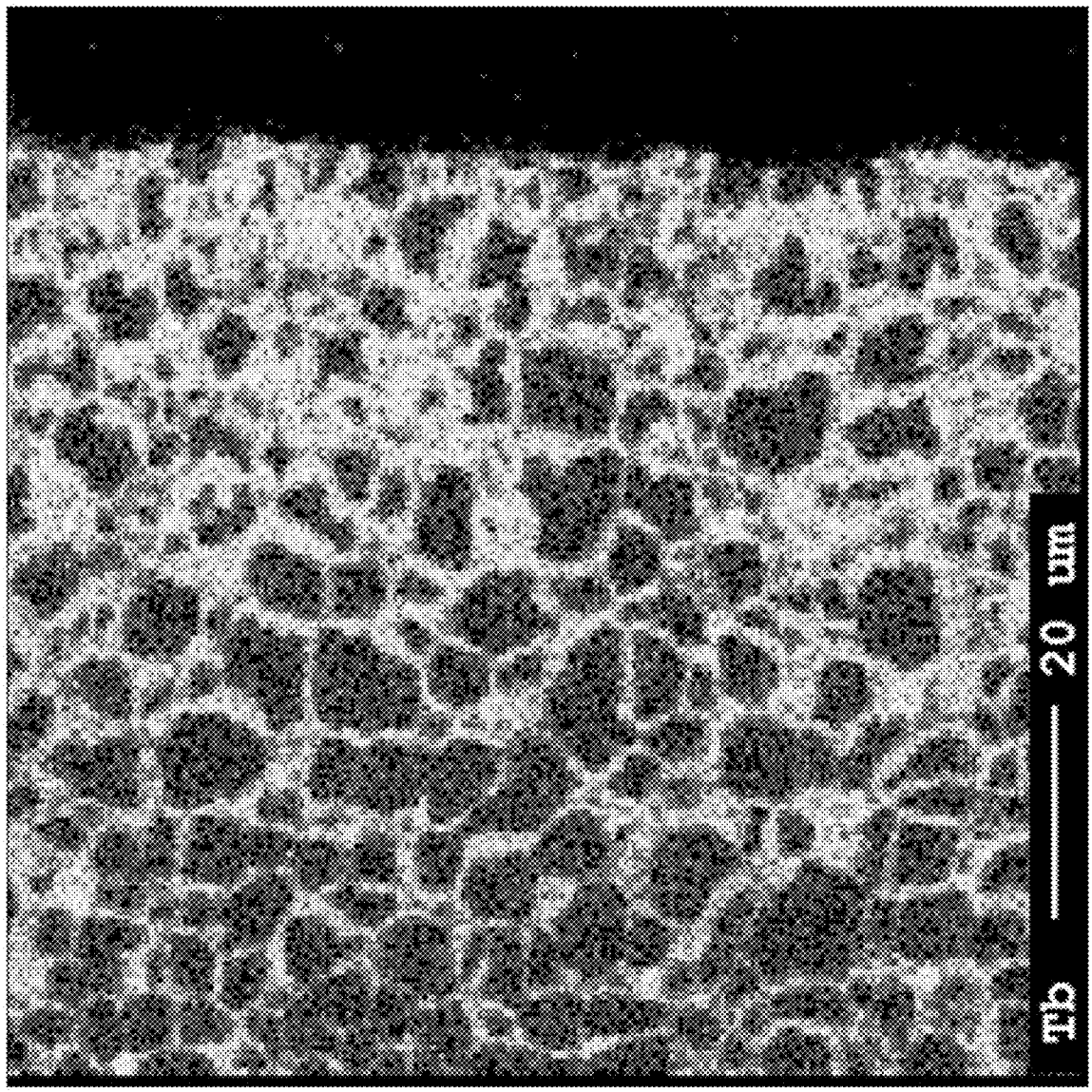
FIG. 5 is an image showing diffusion into the grain boundary of the rare earth permanent magnet produced according to an exemplary embodiment of the present invention.

In the present case, The The grain boundary diffusion material 200 according to an exemplary embodiment of the present invention has a cobalt content of about 1 wt % to about 7 wt % (e.g., about 1 wt %, about 2 wt %, about 3 wt %, about 4 wt %, about 5 wt %, about 6 wt %, or about 7 wt %). The present case is because, when the cobalt content is less than 1 wt %, the improvement in thermal characteristics and coercive force is insufficient, but when the cobalt content exceeds 7 wt %, thermal characteristics and coercive force are deteriorated. FIG. 5 is an image showing diffusion into the grain boundary of the rare earth permanent magnet produced according to an exemplary embodiment of the present invention.

As seen from FIG. 5, according to an exemplary embodiment of the present invention, the grain boundary diffusion material 200 homogeneously diffuses along the grain boundary of the NdFeB sintered magnet 10, thereby advantageously imparting uniform quality to the produced rare earth permanent magnet.

According to the exemplary embodiment of the present invention, by diffusing rare earth elements together with cobalt (Co) with an excellent corrosion resistance and a high melting point, advantageously, the thermal demagnetization rate of the produced rare earth permanent magnet is reduced wherein the thermal characteristics can be improved and diffusion efficiency of the rare earth elements is reduced so that the coercive force of the rare earth permanent magnet can be improved.

In addition, advantageously, an additional process of removing an oxide film after the grain boundary diffusion of the produced rare earth permanent magnet can be omitted so that production efficiency can be improved and production costs can be reduced.

In addition, by offering uniform grain boundary diffusion of rare earth elements in the sintered magnet, the qualities of the produced rare earth permanent magnet can be advantageously uniform.

For convenience in explanation and accurate definition in the appended claims, the terms "upper", "lower", "up", "down", "upwards", "downwards", "inner", "outer", "inside", "outside", "inwardly", "outwardly", "interior", "exterior", "front", "rear", "back", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A method of producing a rare earth permanent magnet comprising:

preparing a NdFeB sintered magnet;

coating a surface of the NdFeB sintered magnet with a grain boundary diffusion material comprising R hydrate or R fluoride, and $R_aM_b$ or M, wherein R is selected from dysprosium (Dy), terbium (Tb), neodymium (Nd), praseodymium (Pr), and holmium (Ho), and wherein M is cobalt (Co), to form a grain boundary diffusion coating layer; wherein the coating includes:

melting R hydrate or R fluoride, and $R_aM_b$ or M to prepare a cobalt molten alloy;

cooling the cobalt molten alloy to prepare a cobalt alloy ingot;

grinding the cobalt alloy ingot to prepare a powdery grain boundary diffusion material; and coating the surface of the NdFeB sintered magnet with the grain boundary diffusion material to form the grain boundary diffusion coating layer, and diffusing the grain boundary diffusion material into a grain boundary of the NdFeB sintered magnet by heat treatment, wherein M is a metal having a melting point higher than a heat treatment temperature during the diffusion, R is a rare earth element, and a and b each represent atomic percentages satisfying Equations (1) and (2):

$$0.1<a<99.9 \quad (1)$$

$$a+b=100 \quad (2).$$

2. The method according to claim 1, wherein M has a melting point of 1,000° C. or higher.

3. The method according to claim 2, wherein the diffusing is conducted by heating to a temperature of 700 to 1,000° C. under an inert atmosphere.

4. The method according to claim 1, wherein, in the preparing, the NdFeB sintered magnet includes 30 to 35 wt % of the total weight of rare earth elements including dysprosium (Dy), terbium (Tb), neodymium (Nd) and praseodymium (Pr), 0 to 10 wt % of the total weight of transition metals including cobalt (Co), aluminum (Al), copper (Cu), gallium (Ga), zirconium (Zr) and niobium (Nb), 1 wt % of boron (B) and the balance of iron (Fe).

5. The method according to claim 4, wherein the grain boundary diffusion material includes R in an amount that is greater than 30 wt % but equal to or less than 70 wt % and is higher than an amount of the rare earth element present in the NdFeB sintered magnet.

6. The method according to claim 1, wherein, in the coating, the grain boundary diffusion material includes 1 to 7 wt % of cobalt (Co).

7. The method according to claim 6, wherein, in the coating, R hydrate is any one of $TbH_2$, $TbH_3$, $DyH_2$ and $DyH_3$, and R fluoride is any one of $TbF_2$, $TbF_3$, $DyF_2$, and $DyF_3$.

8. The method according to claim 1, wherein, in the coating, the coating layer is formed by coating the surface of the NdFeB sintered magnet with the grain boundary diffusion material by spraying, suspension adhesion, or barrel painting.

* * * * *